US006005542A

United States Patent [19]

Yoon

[11] Patent Number: 6,005,542

[45] **Date of Patent: *Dec. 21, 1999**

[54] METHOD FOR DRIVING A THIN FILM TRANSISTOR LIQUID CRYSTAL DISPLAY DEVICE USING VARIED GATE LOW LEVELS

[75] Inventor: Sang Young Yoon, Inchun-si, Rep. of Korea

[73] Assignee: LG Electronics Inc., Seoul, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 08/740,662

[22] Filed: Oct. 31, 1996

[30] Foreign Application Priority Data

Mar. 30, 1996 [KR] Rep. of Korea ..... 96-9546

[51] Int. Cl.[6] ..... G09G 3/36

[52] U.S. Cl. ..... 345/92; 345/96

[58] Field of Search ..... 345/87, 94, 96, 345/99, 92, 90, 95; 349/39, 41, 42, 45, 46, 33, 34

[56] References Cited

U.S. PATENT DOCUMENTS

| | | | |
|---|---|---|---|
| 4,779,956 | 10/1988 | Nemoto et al. | 345/96 |
| 4,909,602 | 3/1990 | Kaneko et al. | 345/92 |
| 5,300,945 | 4/1994 | Iemoto et al. | 345/92 |
| 5,363,225 | 11/1994 | Minamihara et al. | 345/96 |
| 5,506,598 | 4/1996 | Shimada et al. | 345/92 |
| 5,708,454 | 1/1998 | Katoh et al. | 345/87 |

FOREIGN PATENT DOCUMENTS

| | | |
|---|---|---|
| 2-170188 | 6/1990 | Japan . |
| 2-217894 | 8/1990 | Japan . |
| 5-66735 | 3/1993 | Japan . |

*Primary Examiner*—Chanh Nguyen
*Attorney, Agent, or Firm*—Morgan, Lewis & Bockius LLP

[57] ABSTRACT

A method for driving a thin film transistor-liquid crystal display using line inversion includes the steps of applying a gate driving pulse to a gate of the thin film transistor; applying a data signal, varied between low and high data signal levels, to one of a drain and a source of the thin film transistor, the other of the drain and the source connected to a first terminal of a pixel of the liquid crystal display; and applying a common voltage, varied between low and high common voltage levels, to a second terminal of the pixel, the level of the common voltage being inverted with respect to the level of the data signal to drive the pixel in varying directions corresponding to a positive field and a negative field, and the gate driving pulse for a gate low level being varied between the positive field and the negative field.

15 Claims, 4 Drawing Sheets

METHOD FOR DRIVING A THIN FILM TRANSISTOR LIQUID CRYSTAL DISPLAY DEVICE USING VARIED GATE LOW LEVELS

BACKGROUND OF THE INVENTION

1. Field of the Invention

The present invention relates to a method for driving a thin film transistor-liquid crystal display (hereinafter referred to as a TFT-LCD), and more particularly, to a method for driving a TFT-LCD panel using a line inversion driving method.

2. Discussion of the Related Art

A TFT-LCD panel has a pixel array made of a plurality of pixels. FIGS. 1A and 1B show an equivalent circuit diagram for each pixel. Each pixel of the pixel array is connected to a cross point between a scanning line and a data line which meet at a right angle. FIG. 1A is an equivalent circuit diagram of pixels using a storage-on-gate type arrangement in which an auxiliary capacitor $C_s$ for voltage maintenance is formed on the next gate or the previous gate, irrespective of a common electrode. FIG. 1B is an equivalent circuit diagram in which a pixel electrode $C_{LC}$ and an auxiliary capacitor $C_s$ are connected to a common electrode.

As shown in FIG. 1A, a gate line (e.g., a scanning line or a word line) connected to a gate of a thin film transistor (TFT) applies a driving voltage $V_{gn}$ to the gate of the TFT. A video data signal $V_{sig}$ is applied to the drain of the TFT. One terminal of the pixel electrode $C_{LC}$ is connected to a source of the TFT. The other terminal of the pixel electrode $C_{LC}$ is connected to a common voltage $V_{com}$. One terminal of the auxiliary capacitor $C_s$ for maintaining voltage is connected to the pixel electrode $C_{LC}$ in parallel. Finally, the other terminal of the auxiliary capacitor $C_s$ applies the next scanning line voltage $V_{gn-1}$.

As shown in FIG. 1B, a scanning line driving voltage $V_{gn}$ is applied to the gate of a TFT. A video data signal $V_{sig}$ is applied to the drain of the TFT. One terminal of the pixel electrode $C_{LC}$ and the auxiliary capacitor $C_s$ are connected to a source of the TFT. The other terminals of the pixel electrode $C_{LC}$ and the auxiliary capacitor $C_s$ are connected to a common voltage $V_{com}$.

When driving such pixel arrays, if a voltage is applied to a liquid crystal pixel in only one way, degradation of the liquid crystal is accelerated. To avoid this degradation, a video data voltage applied to the liquid crystal periodically oscillates between two levels having opposite polarities. In this case, the polarity of the data voltage should be inverted every field. There are preferably two methods: a field inversion driving method for inverting the polarity of a driving voltage of all pixels of the panel in every field, and a line inversion driving method for alternately inverting the polarity of the driving voltage of every pixel line connected to one scanning line. When inverting the voltage polarity according to the above two methods, a pixel voltage applied to a pixel electrode connected to a drain of the TFT should be positive or negative with respect to the common voltage $V_{com}$.

To apply the data voltage to a pixel of the panel, the TFT should be turned on by applying a driving voltage to a gate of the TFT. FIGS. 2 and 3 show a method for driving a gate voltage at a gate of the TFT, for driving a data voltage at a drain of the TFT, and for driving a common voltage applied to a node of $V_{com}$. FIG. 2 shows a driving method using gate voltage having two levels. FIG. 3 shows a floating gate driving method for floating a gate driving voltage used in a cell array of a storage-on-gate type arrangement in order to maintain a constant phase difference between the gate driving voltage and the common voltage.

In the method for driving a TFT-LCD panel using a line inversion driving method, a polarity of $V_{sig}$ should be opposite that of $V_{com}$ every line. In a single pixel, such polarity characteristics are presented such that polarities of $V_{sig}$ and $V_{com}$ are alternately inverted with respect to each other.

FIG. 2 shows a gate pulse driving method in which a low level of a gate voltage maintains a constant voltage level. Since a pixel voltage $V_p$ is higher than $V_{com}$ in timing pulse period (a), and the pixel voltage $V_p$ is lower than $V_{com}$ in timing pulse period (d), there is a difference between a gate to source voltage $V_{gs}$ and a drain to source voltage $V_{ds}$ in each time period. That is, there is a positive field and a negative field. Herein, the positive field shows that the pixel electrode is charged as a positive voltage higher than $V_{com}$ as shown in timing pulse period (a). Further, the negative field shows that the pixel electrode is charged as a negative voltage lower than $V_{com}$ as shown in timing pulse period (d).

Likewise, FIG. 3 shows a gate pulse driving method in which a low level of the gate voltage is floated. Since a pixel voltage $V_p$ is higher than $V_{com}$ in timing pulse period (a), and the pixel voltage $V_p$ is lower than $V_{com}$ in timing pulse period (d), there is a difference between drain to source voltages $V_{ds}$ in each time period, thereby causing a positive field and a negative field.

FIGS. 4A and 4B show an example of a voltage of each node of a TFT for each timing pulse period using a gate according to FIG. 2. Reference characters (a)–(f) in FIGS. 4A–5B represent the time periods in FIGS. 2 and 3. Accordingly, $V_p$ "0.5V(c)" represents a pixel voltage in timing pulse period (c).

FIG. 2 is an example showing that a voltage difference between a gate to source voltage and a source to drain voltage occurs. As shown in FIG. 2, a difference between $V_{gs}$ of a positive field and $V_{gs}$ of a negative field increases over the period between timing pulse periods (b) and (c), when the scanning line connected to the pixels is sequentially selected.

To display an entire screen as a color of a constant brightness and to achieve the same color and brightness of every pixel while displaying the entire screen, three signals are employed. That is, a gate driving pulse is shown as a rectangular wave signal ranging from −15V to +10V, data signal $V_{sig}$ is shown as a second rectangular wave signal ranging from −2.8V to +1.2V, and a common voltage $V_{com}$ is shown as a third rectangular wave signal ranging form −3.8V to +1.2V.

As shown in FIG. 4A, when a positive field is applied to the pixel and a gate driving pulse of −15V is in timing pulse period (a), the TFT is turned on by applying a voltage of +10V. When a data voltage of +0.8V is applied to a drain, a voltage drop of 0.3V occurs and then +0.5V is applied to the pixel electrode. Therefore, −3.8V is applied to $V_{com}$, and a voltage difference 4.3V is charged to the pixel electrode which is a capacitor between a pixel electrode and a common electrode.

In a timing pulse period (b) in which a second scanning line is selected, a gate driving pulse is −15V, a data signal $V_{sig}$ is −2.8V, and a common voltage $V_{com}$ is +1.2V. $V_p$ of a pixel electrode is higher than $V_{com}$ by +4.3V, that is, $V_p$ is expressed as 4.3V +1.2V=5.5V, thus $V_p$ becomes a high state.

In a timing pulse period (c) in which a third scanning line is selected, the gate driving pulse is −15V, the data signal $V_{sig}$ is +0.8V, and the common voltage $V_{com}$ is −3.8V. Thus, $V_p$ of the pixel electrode becomes a low state of +0.5V, since $V_{com}$ is −3.8V.

As shown in FIG. 4B, when a negative field is applied to pixel and an initial gate potential is −15V is in a timing pulse period (d), the TFT is turned on by applying a voltage of +10V to the gate. When a data voltage of −2.8V is applied to a drain, a voltage drop of 0.3V occurs and then −3.1V is applied to the pixel electrode. Therefore, +1.2V is applied to $V_{com}$, a voltage difference 4.3V is charged to the pixel electrode like the preceding positive field. However, the pixel electrode is charged by a more negative field than the node of $V_{com}$.

In timing pulse period (e) in which the next scanning line is selected. The gate driving pulse is −15V, the data signal $V_{sig}$ is +0.8V, and the common voltage $V_{com}$ is −3.8V. Thus, $V_p$ of the pixel electrode is expressed as (−3.8V)+(−4.3V)=−8.1V, thus $V_p$ becomes a low state.

In timing pulse period (f) in which the next scanning line is selected, the gate driving pulse is −15V, the data signal $V_{sig}$ is −2.8V, and the common voltage $V_{com}$ is +1.2V. Thus, $V_p$ of the pixel electrode becomes a high state of −3.1V.

Under these operations, in the case of timing pulse period (b) of the positive field shown in FIG. 4A, each voltage between terminals of TFT is as follows. A gate to source voltage $V_{gs}$ is expressed as [−15 −5.5]=−20.5V, a drain to source voltage $V_{ds}$ is expressed as [−2.8−5.5]=−8.3V, and a gate to drain voltage $V_{gd}$ is expressed as [−15−(−2.8)]=−12.2V.

In the timing pulse period (c), the gate to source voltage $V_{gs}$ is expressed as [−15−0.5]=−15.5V, the drain to source voltage $V_{ds}$ is expressed as [−0.8+0.5]=−0.3V, and the gate to drain voltage $V_{gd}$ is expressed as [−15−0.8]=−15.8V.

Next, in the case of timing pulse period (e) of the negative field shown in FIG. 4B, each of the voltage between terminals of TFT is as follows. A gate to source voltage $V_{gs}$ is expressed as [−15−(−8.1)]=−6.9V, a drain to source voltage $V_{ds}$ is expressed as [0.8−(−8.1)]=8.9V, and a gate to drain voltage $V_{gd}$ is expressed as [−15−0.8]=−15.8V.

In timing pulse period (f), the gate to source voltage $V_{gs}$ is expressed as [−15−(−3.1)]=−11.9V, the drain to source voltage $V_{ds}$ is expressed as [−2.8−(−3.1)]=0.3V, and the gate to drain voltage $V_{gd}$ is expressed [−15−(−2.8)]=−12.2V.

As described above, there is a voltage difference between the nodes of the TFT while scanning both the positive field and the negative field. For example, a $V_{gs}$ of −20.5V in the time pulse period (b) of the positive field is changed to a $V_{gs}$ of −6.9V in time pulse period (e) of the negative field, $V_{ds}$ ranges from −8.3V to −8.9V, and $V_{gd}$ ranges from −12.2V to −15.8V.

In addition, a $V_{gs}$ of −15.5V in time pulse period (c) of the positive field is changed to a $V_{gs}$ of −11.9V in time pulse period (f) of the negative field, $V_{ds}$ ranges from −0.3V to −0.3V, and $V_{gd}$ ranges from −15.8V to −12.2V. As a result, these voltage variations cause unstable leakage current in the TFT, and the unstable leakage current is periodically generated when scanning in the positive field and the negative field, thereby causing a 30 Hz flicker.

FIGS. 5A and 5B show each node voltage of a TFT using the floating gate driving method shown in FIG. 3, in which even though a voltage difference of $V_{gs}$ between the positive field and negative field is decreased, a voltage difference of $V_{ds}$ is still high.

In the floating gate driving method, in the case of timing pulse period (b) for selecting the next scanning line, a gate driving pulse is −10V as a high level, data signal $V_{sig}$ is −2.8V as a low level, and a common voltage $V_{com}$ is 1.2V as a high level.

In timing pulse period (c) for selecting the next scanning line, the gate driving pulse is −15V as a low level, and the data signal $V_{sig}$ is +0.8V as a high level, the common voltage $V_{com}$ is −3.8V as a low level.

As shown in FIG. 5A, when a positive field is applied to pixel in timing pulse period (b), the gate driving pulse is −10V as a low level, the data signal $V_{sig}$ is −2.8V as a low level, and the common voltage $V_{com}$ is +1.2V as a high level. Thus, $V_p$ of the pixel electrode becomes a high state of 5.5V.

In timing pulse period (c), the gate driving pulse is −15V as a low level, the data signal $V_{sig}$ is +0.8V as a high level, and the common voltage $V_{com}$ is −3.8V as a low level. Thus, $V_p$ of the pixel becomes a low state of +0.5V.

As shown in FIG. 5B, when a negative field is applied to a pixel in a timing pulse period (e), the gate driving pulse is −15V as a low level, the data signal $V_{sig}$ is +0.8V as a high level, and the common voltage $V_{com}$ is −3.8V as a low level. Thus, $V_p$ of the pixel becomes a low state of −8.1V.

In timing pulse period (f), the gate driving pulse is −10V as a high level, the data signal $V_{sig}$ is −2.8V as a low level, and the common voltage $V_{com}$ is +1.2V as a high level. Thus, $V_p$ of the pixel becomes a high state of −3.1V.

In the case of timing pulse period (b) of the positive field shown in FIG. 5A, each voltage between terminals of the TFT is as follows. A gate to source voltage $V_{gs}$ is expressed as [−10−5.5]=−15.5V, a drain to source voltage $V_{ds}$ is expressed as [−2.8−5.5]=−8.3V, and a gate to drain voltage $V_{gd}$ is expressed as [−10−(−2.8)]=−8.2V.

In the timing pulse period (c) shown in FIG. 5A, the gate to source voltage $V_{gs}$ is expressed as [−15−0.5]=−15.5V, the drain to source voltage $V_{ds}$ is expressed as [0.8−0.5]=0.3V, and the gate to drain voltage $V_{gd}$ is expressed as [−15−0.8]=−15.8V.

In the case of timing pulse period (e) of the positive field shown in FIG. 5B, each voltage between the terminals of the TFT is as follows. A gate to source voltage $V_{gs}$ is expressed as [−15−(−8.1)]=−6.9V, a drain to source voltage $V_{ds}$ is expressed as [0.8−(−8.1)]=8.9V, and a gate to drain voltage $V_{gd}$ is expressed as [−15−0.8]=−15.8V.

In timing pulse period (f) shown in FIG. 5B, the gate to source voltage $V_{gs}$ is expressed as [−10−(−3.1)]=−6.9V, the drain to source voltage $V_{ds}$ is expressed as [−2.8−(−3.1)]=0.3V, and the gate to drain voltage $V_{gd}$ is expressed as [−10−(−2.8)]=−7.2V.

There is no variation of $V_{gs}$ in the floating gate driving method. However, there is a voltage variation in $V_{ds}$ and $V_{gd}$ because $V_{ds}$ is expressed as $V_{ds(b)}-V_{ds(e)}$=−8.3−8.9 =−17.2 and $V_{gd}$ is expressed as $V_{gd(b)}-V_{gd(e)}$=−8.2−(−15.8)=7.6V.

As described above, such voltage variations between the terminals of a TFT causes the screen to flicker. The flicker can be explained by FIG. 6 which shows the characteristics of current versus voltage in the TFT.

As shown in FIGS. 6 and 7, leakage current occurs in an OFF-region according to a graph of source-to-drain current $I_{ds}$. As the absolute value of $V_{gs}$ increases, the leakage current increases. Therefore, there is a difference of gate-to-source voltages $V_{gs}$ between time periods of the positive field and the negative field. Because a difference of leakage current occurs, a light transmittance is varied by a root-mean-square (rms) voltage difference between the positive field and the negative field, thereby causing a 30 Hz flicker.

FIG. 7 depicts the above operations. Although a liquid crystal voltage (position A; reference number 71) which is fully charged in the positive field is identical with another liquid crystal voltage (position B; reference number 73) which is also fully charged in a negative field, there is a voltage difference after one field, since an electric charge included in the pixel electrode is greatly discharged or minutely discharged. Accordingly, a voltage difference between a position C (72) and a position D (74) of FIG. 7 is greatly generated, thereby generating a difference between rms voltages of two fields and causing flicker.

SUMMARY OF THE INVENTION

Accordingly, the present invention is directed to a method for driving a thin film transistor liquid crystal display that substantially obviates one or more of the problems due to limitations and disadvantages of the related art.

An object of the present invention is to provide a method for driving TFT-LCD panel using a line inversion driving method which eliminates flicker.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the method for driving a thin film transistor-liquid crystal display using line inversion includes the steps of applying a gate driving pulse to a gate of the thin film transistor; applying a data signal, varied between low and high data signal levels, to one of a drain and a source of the thin film transistor, the other of the drain and the source connected to a first terminal of a pixel of the liquid crystal display; and applying a common voltage, varied between low and high common voltage levels, to a second terminal of the pixel, the level of the common voltage being inverted with respect to the level of the data signal to drive the pixel in varying directions corresponding to a positive field and a negative field, and the gate driving pulse for a gate low level being varied between the positive field and the negative field.

In another aspect, the method, for driving a thin film transistor-liquid crystal display including a thin film transistor having a gate, a drain, and a source and a liquid crystal cell having a first terminal coupled to the source of the thin film transistor and a second terminal coupled to a common electrode includes the steps of applying a data signal to the drain of the thin film transistor and a common voltage signal to the common electrode, each of the data signal and the common voltage signal alternating between high and low signal levels; and applying a gate driving signal to a gate of the thin film transistor, the gate driving signal having a high level for turning the thin film transistor ON during positive and negative fields, a first low level, and a second low level.

A gate modulation driving method according to the present invention can be applicable to all storage capacitances for maintaining a constant voltage. Here, a storage capacitance is a storage-on-common type shown in FIG. 1B, or is a storage-on-gate type shown in FIG. 1A.

In order to eliminate a discordance between the gate to source voltages $V_{gs}$ of positive field and negative field, the present invention makes a gate voltage of which low level be varied in a positive field and a negative field.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE INVENTION

Reference will now be made in detail to the preferred embodiments of the present invention, examples of which are illustrated in the accompanying drawings. The preferred embodiments of the present invention will become apparent from a study of the following detailed description, when viewed in light of the accompanying drawings.

Figure 8:
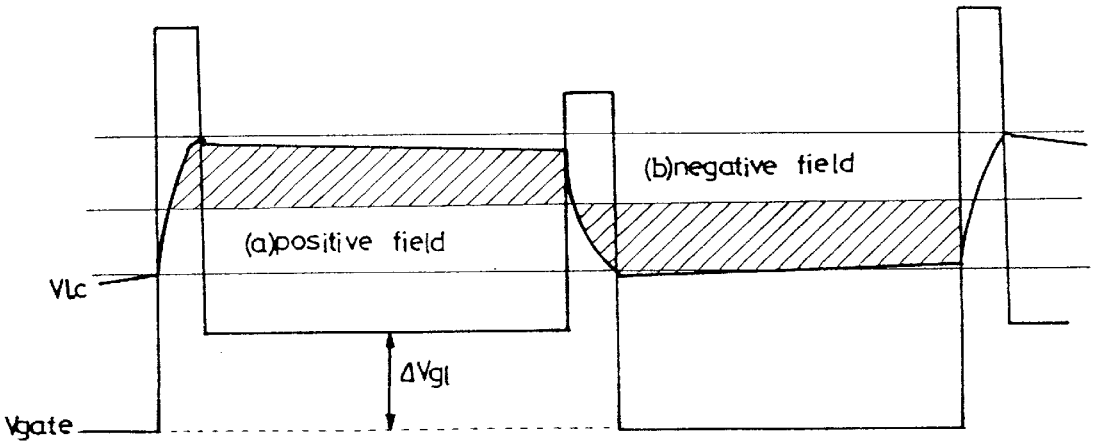
FIG. 8 is a voltage plot showing the principle for reducing a flicker in a line inversion driving method in accordance with a preferred embodiment of the present invention.

A basic principle for the present invention is shown in FIG. 8, which illustrates a gate pulse wave for one pixel. As shown in FIG. 8, a low gate voltage $V_{gl}$ between positive field and negative field can be calculated as described below.

Figure 1A:
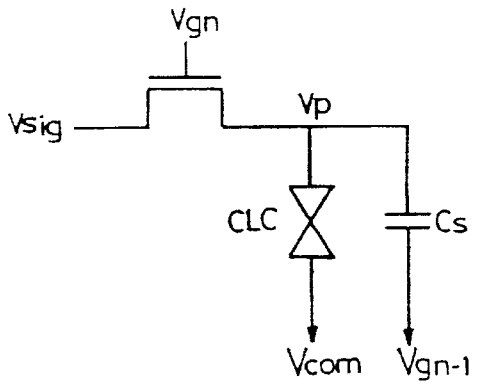
FIG. 1a Prior Art
FIGS. 1A and 1B are equivalent circuit diagrams of a pixel of a TFT-LCD panel.
Figure 1B:
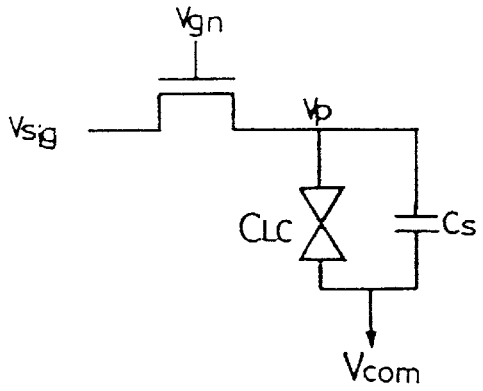
FIG. 1b Prior Art
Figure 2:
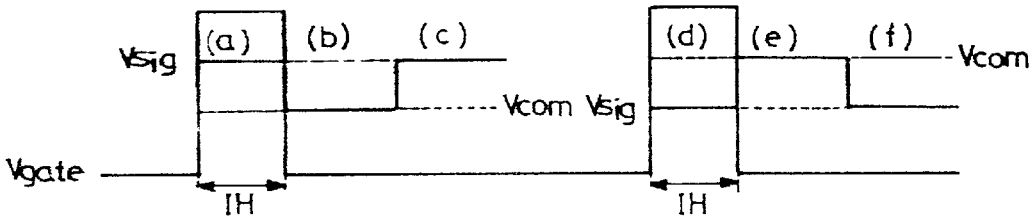
FIG. 2 Prior Art
FIG. 2 shows waveforms and a timing diagram of a gate driving pulse of a TFT-LCD panel using a line inversion driving method.
Figure 3:
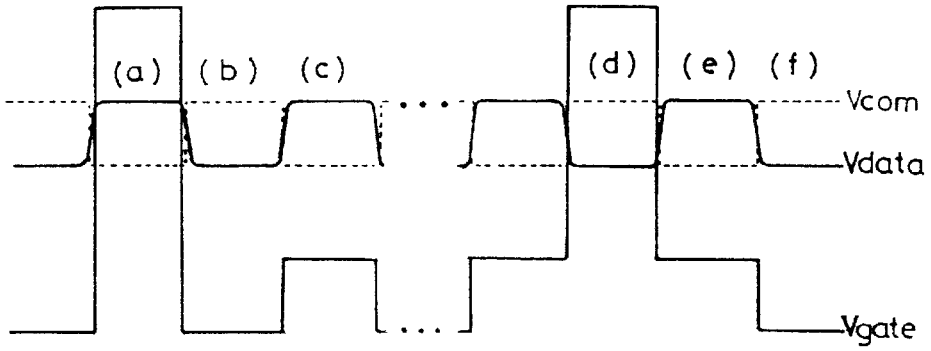
FIG. 3 Prior Art
FIG. 3 shows waveforms and a timing diagram of a gate driving pulse of a TFT-LCD panel using a floating gate driving method.
Figure 4A:
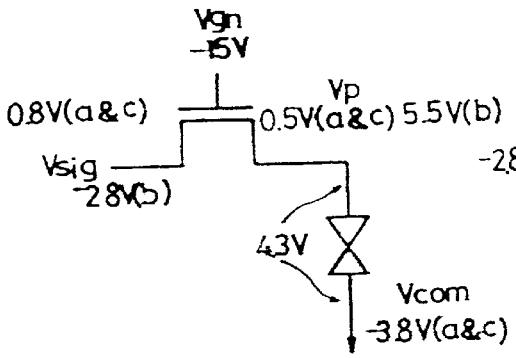
FIG. 4a Prior Art
FIGS. 4A and 4B are circuit diagrams which show operating voltage levels of each node of a TFT for a pixel when driving a TFT according to a line inversion driving method.
Figure 4B:
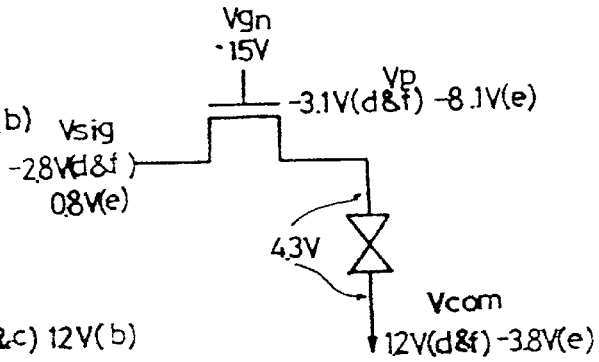
FIG. 4b Prior Art
Figure 5A:
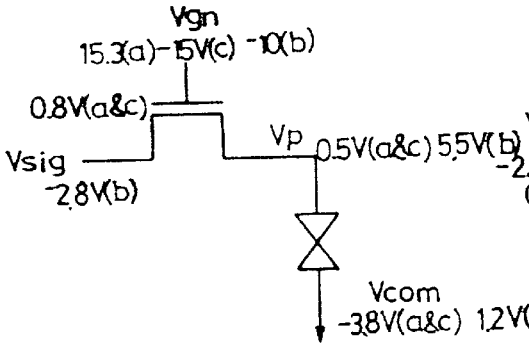
FIG. 5a Prior Art
FIGS. 5A and 5B are circuit diagrams which show operating voltage levels of each node of a TFT for a pixel when driving a TFT according to a floating gate driving method.
Figure 5B:
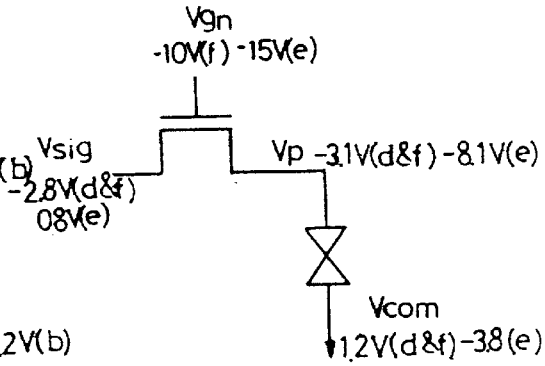
FIG. 5b Prior Art
Figure 6:
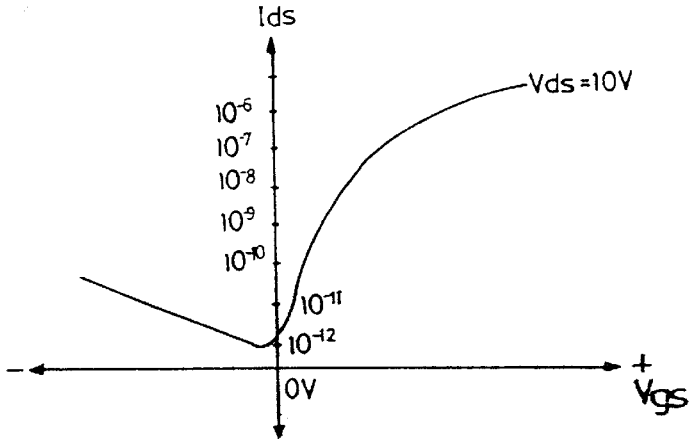
FIG.6 Prior Art
FIG. 6 is a characteristic curve of a leakage current in a TFT.
Figure 7:
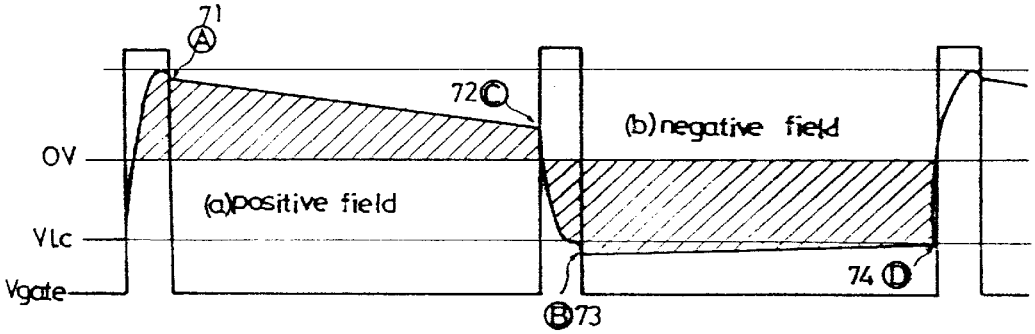
FIG.7 Prior Art
FIG. 7 is a voltage plot showing the principle of a flicker according to the conventional line inversion driving method.

Even though $V_{sig}$ is described in FIG. 2, 4A and 4B as a rectangular wave signal, $V_{sig}$ is actually a random wave which is varied according to a video signal. Therefore, a charging voltage charged to a pixel is varied by the video signal, and a difference between gate to source voltages $V_{gs}$ in a positive field and a negative field is a function of the video signal. However, if the video signal is random, an average value of the video signal is an intermediate signal between a white level and a black level. For example, the intermediate signal is a 50% IRE signal in the case of a TV signal. When determining $V_{gl}$, assuming a pixel is charged to the average value of the video signal, it is desirable that a value of $\Delta V_{gl}$ is equal to a difference of $V_{gs}$ between the positive field and the negative field on the assumption that the average value of the video signal is inputted to the $V_{sig}$. As a result, $\Delta V_{gl}$ of FIG. 4 is about 5.3V.

To explain $\Delta V_{gl}$ in detail, a low level of the gate voltage for turning off a TFT is designated $V_{gatelow}$, low and high levels of the data signal are designated $V_{siglow}$ and $V_{sighigh}$, and low and high levels of the common voltage $V_{com}$ are designated $V_{comlow}$ and $V_{comhigh}$. Under these circumstances, $V_{gs}=V_g-V_s$.

In the case of a positive field, as for $V_{gs1}$ after the TFT is turned off, a gate voltage is $V_{gatelow}$, a source voltage $V_s$ is $V_{comhigh}+V_{lc}$, where $V_{lc}$ is a pixel charging voltage of $V_{sighigh}-V_{comlow}-\Delta Vt$. $\Delta Vt$ refers to the drop voltage in the TFT.

But, $V_{comhigh}+V_{lc}>V_{siglow}$, so that a real $V_{gs1}$ becomes $V_{gatelow}-V_{siglow}$.

In the case of a negative field, as for $V_{gs2}$ after the TFT is turned off, a gate voltage $V_{gate}$ is $V_{gatelow}$, a source voltage $V_s$ is $V_{comlow}+V_{lc}$, where $V_{lc}$ is a pixel charging voltage of $V_{siglow}-V_{comhigh}-\Delta Vt$. Accordingly, $V_{gs2}=V_{gatelow}-V_{comlow}+V_{comhigh}-V_{siglow}+\Delta Vt$.

A voltage difference $\Delta V_{gs}$ between $V_{gs1}$ of positive field and $V_{gs2}$ of negative field is as follows:

$$\begin{aligned}\Delta V_{gs}&=V_{gs2}-V_{gs1}\\&=V_{gatelow}-V_{comlow}+V_{comhigh}-V_{siglow}+\Delta Vt-(V_{gatelow}-V_{siglow})\\&=V_{comlow}+V_{comhigh}+\Delta Vt\end{aligned}$$

The value of $\Delta V_{gs}$ through a numeric calculation may be expressed as −(−3.8)+1.2+0.3=5.3V.

Figure 9:
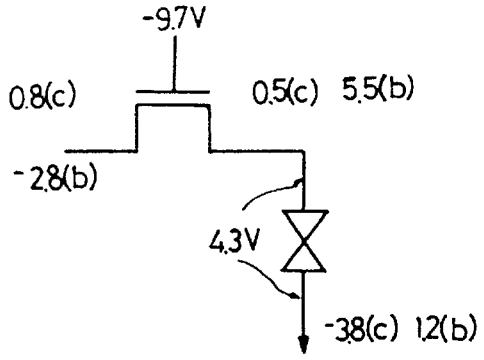
FIG. 9 is a circuit diagram which shows operating voltage levels of each node of a TFT regarding one pixel when driving a TFT according to a line inversion driving method in accordance with a preferred embodiment of the present invention.

When $V_{gatelow}$ of the positive field is higher than $V_{gatelow}$ of the negative field by 5.3V according to $\Delta V_{gs}$ as calculated by the above procedures, each node state of the TFT is shown in FIGS. 4A, 4B and 9.

To achieve the same color and brightness in every pixel while displaying the entire screen, in the case that an electric potential of a gate driving pulse is higher than that of the gate low voltage by $\Delta V_{gs}$ in the negative field, each node voltage expressed as rectangular wave signal is as follows.

A low level of a gate driving pulse is −9.7V in a positive field, or is −15V in a negative field. A high level of the gate driving pulse is +15.3V in apositive field, or is +10V in a negative field. A data signal $V_{sig}$ ranges from −2.8V to +0.8V, and a common voltage $V_{com}$ ranges from −3.8V to +1.2V.

When a positive field is applied to the pixel, a TFT is turned on by applying a voltage of +15.3V to a gate in timing pulse period (a). When a data voltage of +0.8V is applied to a drain, a voltage drop of 0.3V occurs and then +0.5V is applied to the pixel electrode. Therefore, −3.8V is applied to $V_{com}$, a voltage difference of 4.3V is charged to the pixel electrode.

As shown in FIG. 9, in timing pulse period (b) in which the next scanning line is selected, a gate driving pulse is −9.7V as a low level, a data signal $V_{sig}$ is −2.8V as a low level, and a common voltage $V_{com}$ is +1.2V as a high level. $V_p$ of a pixel electrode is higher than $V_{com}$ by +4.3V, that is, $V_p$ is expressed as 4.3V+1.2V=5.5V, thus $V_p$ becomes a high state of 5.5V.

In timing pulse period (c) in which the next scanning line is selected, the gate driving pulse is −9.7V as a low level, the data signal $V_{sig}$ is +0.8V as a high level, and the common voltage $V_{com}$ is −3.8V as a low level. Thus, $V_p$ of the pixel electrode becomes a low state of +0.5V, since $V_{com}$ is −3.8V.

As shown in FIG. 4B, when a negative field is applied to pixel, a TFT is turned on by applying a voltage of +10V in timing pulse period (d). When a data voltage of −2.8V is applied to a drain, a voltage drop of 0.3V occurs and then −3.1V is applied to the pixel electrode. Therefore, +1.2V is applied to $V_{com}$, a voltage difference of 4.3V is charged to the pixel electrode like the preceding positive field. However, the pixel electrode is charged with a more negative field than the node of $V_{com}$.

In timing pulse period (e) in which the next scanning line is selected, the gate driving pulse is −15V as a low level, the data signal $V_{sig}$ is +0.8V as a high level, and the common voltage $V_{com}$ is −3.8V as a low level. Thus $V_p$ of the pixel electrode is expressed as a (−3.8V)+(−4.3V)=−8.1V, thus $V_p$ becomes a low state of −8.1V.

In timing pulse period (f) in which the next scanning line is selected, the gate driving pulse is −15V as a low level, the data signal $V_{sig}$ is −2.8 as a low level, and the common voltage $V_{com}$ is +1.2V as a high level. Thus, $V_p$ of the pixel electrode becomes a high state of −3.1V.

In the case of timing pulse period (b) of the positive field shown in FIG. 9, the voltages between the terminals of the TFT are as follows. A gate to source voltage $V_{gs}$ is expressed as [−9.7−5.5]=−15.2V, a drain to source voltage $V_{ds}$ is expressed as [−2.8−5.5]=−8.3V, and a gate to drain voltage $V_{gd}$ is expressed as [−9.7−(−2.8)]=−6.9V.

In timing pulse period (c), the gate to source voltage $V_{gs}$ is expressed as [−9.7−0.5]=−9.2V, the drain to source voltage $V_{ds}$ is expressed as [−0.8+0.5]=−0.3V, and the gate to drain voltage $V_{gd}$ is expressed as [−9.7−0.8]=−10.5V.

In the case of timing pulse period (e) of the negative field shown in FIG. 4B, each voltage between terminals of TFT is as follows. A gate to source voltage $V_{gs}$ is expressed as [−15−(−8.1)]=−6.9V, a drain to source voltage $V_{ds}$ is expressed as [0.8−(−8.1)]=8.9V, and a gate to drain voltage $V_{gd}$ is expressed as [−15−0.8]=−15.8V.

In timing pulse period (f), the gate to source voltage $V_{gs}$ is expressed as [−15−(−3.1)]=−11.9V, the drain to source voltage $V_{ds}$ is expressed as [−2.8−(3.1)]=0.3V, and the gate to drain voltage $V_{gd}$ is expressed as [−15−(−2.8)]=−12.2V.

As described above, there is no change in a voltage value between nodes of TFT while scanning both the positive field and the negative field. That is, $V_{gs}$ of −15.2V in the time pulse period (b) of positive field is changed to $V_{gs}$ of −6.9V in time pulse period (e) of a negative field, and $V_{ds}$ ranges from −8.3V to −8.9V, and $V_{dg}$ ranges from −6.9V to −15.8V.

In addition, $V_{gs}$ of −11.9V in the time pulse period (f) of negative field is changed to $V_{gs}$ of −9.2 in positive field (c), $V_{ds}$ ranges from −0.3 to 0.3V, and $V_{gd}$ ranges from −10.5V to −12.2V. However, because $V_s>V_d$ in period (b), an actual $V_{gs}$ is the same as 6.9V of $V_{gd}$, and this is the same as $V_{gs}$ in period (e).

As described above, a difference of $V_{gs}$ between the positive field and the negative field is decreased. In addition, $V_{gs}$ of timing pulse period (b) of the positive field is identical with another $V_{gs}$ of timing pulse period (e) of the negative field, so that two fields have the same holding ratio.

However, there is a discordance between $\Delta V_{gl}$ of FIG. 8 and the computed $\Delta V_{gl}$ in a real signal. A simulation result of a panel shows a minute discordance between $V_{gl}$ having a minimum holding ratio difference between the positive field and the negative field and the computed $V_{gl}$, while applying waveforms of FIG. 2. This means that the value of $\Delta V_{gl}$ is affected by the panel. Because $\Delta V_p$ is varied in each panel, it is more desirable that user can adjust the value of $\Delta V_{gl}$ in order to modulate the gate voltage.

Figure 10:
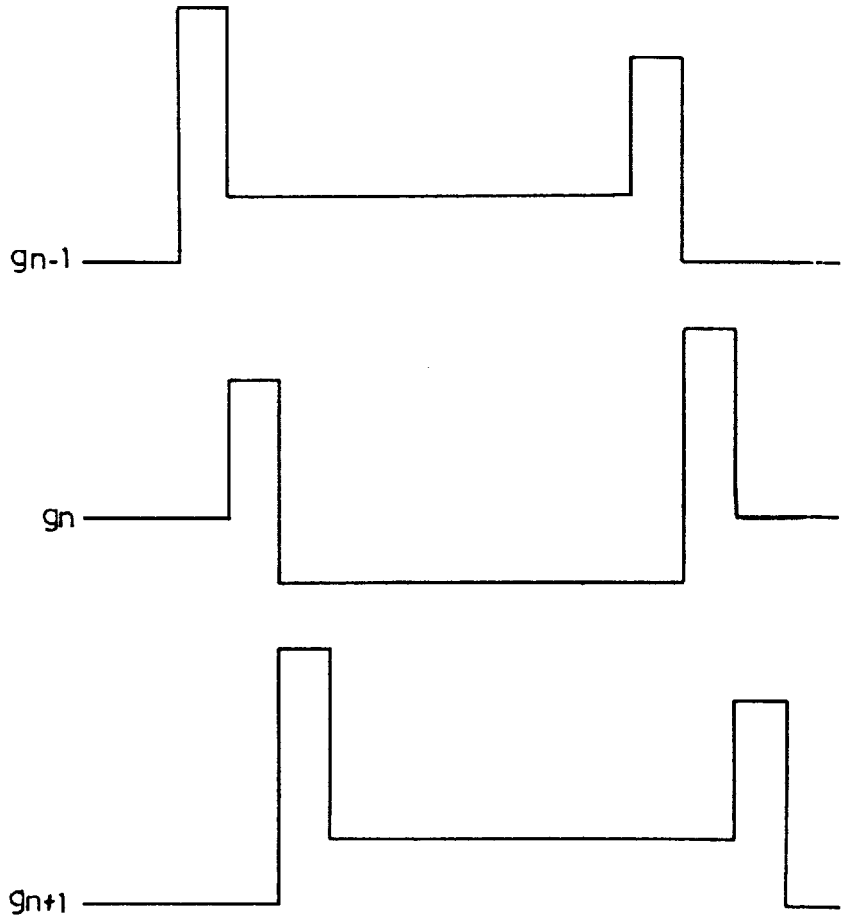
FIG. 10 shows waveforms and a timing diagram of a gate driving pulse of TFT-LCD panel using the line inversion driving method in accordance with a preferred embodiment of the present invention.

FIG. 10 shows gate driving pulses of a line inversion driving method in accordance with a preferred embodiment of the present invention. As shown in FIG. 10, a pulse waveform for driving a gate line connected to a pixel is shown as a first pulse signal gn, a second pulse signal gn−1 is applied to the previous gate line of the first pulse signal gn, and a third pulse signal gn+1 is applied to the next gate line of the first pulse signal gn.

As a result, when driving TFT-LCD according to a line inversion driving method, the present invention reduces 30 Hz flicker caused by a leakage current difference between positive field and negative field. That is, the method for driving a TFT-LCD panel using a line inversion driving method reduces leakage current difference between a positive field and a negative field, thereby reducing 30 Hz flicker.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art which this invention pertains.

What is claimed is:

1. A method for driving a thin film transistor-liquid crystal display using a line inversion driving method, the method comprising the steps of:

driving a gate line by applying a first gate low level voltage to the gate line during a positive field with a liquid crystal voltage of the display being fully charged at a beginning part of the positive field and at least partially discharged at an end part of the positive field; and driving the gate line by applying a second gate low level voltage to the gate line during a negative field with the liquid crystal voltage of the display being fully charged at a beginning part of the negative field and at least partially discharged at an end part of the negative field, the driving steps being performed such that the at least partially discharged liquid crystal voltages of the positive and negative fields are substantially identical in magnitude and such that a magnitude of a difference between the first gate low level voltage applied during a high level of a common voltage in the positive field and the second gate low level voltage applied during the high level of the common voltage in the negative field is substantially equal to the magnitude of a voltage difference between the high level and a low level of the common voltage, the first gate low level voltage being applied only during the positive field and the second gate low level voltage being applied only during the negative field.

2. The method according to claim 1, wherein the first and second gate low level voltages are substantially constant during each of the respective positive and negative fields.

3. The method according to claim 1, wherein the driving steps reduce a leakage current difference between the positive and negative fields to decrease flicker in the display.

4. The method according to claim 1, wherein a magnitude of a difference between the first gate low level voltage applied during a low level of the common voltage in the positive field and the second gate low level voltage applied during the low level of the common voltage in the negative field is substantially equal to the magnitude of a voltage difference between the high level and the low level of the common voltage.

5. A method for driving a thin film transistor-liquid crystal display using line inversion, the method comprising the steps of:

applying a gate driving pulse to a gate of the thin film transistor;

applying a data signal, varied between low and high data signal levels, to one of a drain and a source of the thin film transistor, the other of the drain and the source connected to a first terminal of a pixel of the liquid crystal display; and applying a common voltage, varied between low and high common voltage levels, to a second terminal of the pixel, the level of the common voltage being inverted with respect to the level of the data signal to drive the pixel in varying directions corresponding to a positive field and a negative field, and the applied gate driving pulse for a gate low level being varied between a first low level for the positive field and a second low level for the negative field in a manner such that leakage current rates of the positive and negative fields are substantially the same and a magnitude of a voltage difference between the first low level of the varied gate low level applied during the high common voltage level in the positive field and the second low level of the varied gate low level applied during the high common voltage level in the negative field is substantially equal to a magnitude of a difference between the low and high common voltage levels, the first low level of the gate low level being applied only during the positive field and the second low level of the gate low level being applied only during the negative field.

6. The method according to claimed 5, wherein the first and second low levels have substantially constant voltages.

7. The method according to claim 5, wherein the applying steps reduce a leakage current difference between the positive and negative fields to decrease flicker in the display.

8. The method according to claim 5, a magnitude of a voltage difference between the first low level of the varied gate low level applied during low high common voltage level in the positive field and the second low level of the varied gate low level applied during the low common voltage level in the negative field is substantially equal to a magnitude of a difference between the low and high common voltage levels.

9. A method for driving a thin film transistor-liquid crystal display including a thin film transistor having a gate, a drain, and a source and a liquid crystal cell having a first terminal coupled to the source of the thin film transistor and a second terminal coupled to a common electrode, the method comprising the steps of:

applying a data signal to the drain of the thin film transistor and a common voltage signal to the common electrode, each of the data signal and the common voltage signal alternating between high and low signal levels; and applying a gate driving signal to a gate of the thin film transistor, the gate driving signal having a high level for turning the thin film transistor ON during positive and negative fields, having a first low level applied only during the positive field for turning the thin film transistor OFF, and having a second low level applied only during the negative field for turning the thin film transistor OFF, wherein the applying steps are performed such that a magnitude of a voltage difference between the first low level of the gate driving signal applied during the high level of the common voltage signal in the positive field and the second low level of the gate driving signal applied during the high level of the common voltage signal in the negative field is substantially equal to a magnitude of a voltage difference between the high level and the low level of the common voltage signal.

10. The method according to claim 9, wherein the first and second low levels of the gate driving signal are substantially constant voltage levels.

11. The method according to claim 9, wherein the applying steps reduce a leakage current difference between the positive and negative fields to decrease flicker in the display.

12. The method according to claim 9, wherein the applying steps are performed such that a magnitude of a voltage difference between the first low level of the gate driving signal applied during the low level of the common voltage signal in the positive field and the second low level of the gate driving signal applied during the low level of the common voltage signal in the negative field is substantially equal to a magnitude of a voltage difference between the high level and the low level of the common voltage signal.

13. A method for driving a thin film transistor-liquid crystal display including a thin film transistor having a gate, a drain, and a source and a liquid crystal cell having a first terminal coupled to the source of the thin film transistor and a second terminal coupled to a common electrode, the method comprising the steps of:

applying a data signal to the drain of the thin film transistor and a common voltage signal to the common electrode, each of the data signal and the common voltage signal alternating between high and low signal levels; and applying a gate driving signal to a gate of the thin film transistor, the gate driving signal consisting of a first high level for turning the thin film transistor ON and a first low level for turning the thin film transistor OFF during positive fields, the gate driving signal consisting of a second high level for turning the thin film transistor ON and a second low level for turning the thin film transistor OFF during negative fields, wherein the first and second low levels have different voltage levels, and wherein the applying steps are performed such that a magnitude of a voltage difference between the first low level of the gate driving signal applied during the high level of the common voltage in the positive field and the second low level of the gate driving signal applied during the high level of the common voltage in the negative field is substantially equal to a magnitude of a voltage difference between the high level and the low level of the common voltage signal, the first low level only being applied during the positive fields and the second low level only being applied during the negative fields.

14. The method according to claim 13, wherein the driving steps reduce a leakage current difference between the positive and negative fields to decrease flicker in the display.

15. The method according to claim 13, wherein a magnitude of a voltage difference between the first low level of the gate driving signal applied during the low level of the common voltage in the positive field and the second low level of the gate driving signal applied during the low level of the common voltage in the negative field is substantially equal to a magnitude of a voltage difference between the high level and the low level of the common voltage signal.

* * * * *